United States Patent [19]

Reuter

[11] Patent Number: 4,535,685

[45] Date of Patent: Aug. 20, 1985

[54] AIR OUTLET FOR AIR CONDITIONING SYSTEMS

[75] Inventor: Rolf Reuter, Essen, Fed. Rep. of Germany

[73] Assignee: Maurmann Ingenieurbüro GmbH, Heiligenhaus, Fed. Rep. of Germany

[21] Appl. No.: 586,061

[22] Filed: Mar. 5, 1984

[51] Int. Cl.[3] ..... F24F 13/06

[52] U.S. Cl. ..... 98/40.12; 98/41.1

[58] Field of Search ..... 98/40 R, 40 D, 40 N, 98/41 R, 40 B, 40 V; 137/512.1, 513

[56] References Cited

U.S. PATENT DOCUMENTS

| | | | |
|---|---|---|---|
| 3,464,341 | 9/1969 | Dobrin | 98/110 |
| 3,554,111 | 1/1971 | Traver et al. | 98/40 D |
| 3,718,156 | 2/1973 | Fujii | 137/512.1 |
| 4,320,696 | 3/1982 | Daniels et al. | 93/40 R X |

FOREIGN PATENT DOCUMENTS

| | | | |
|---|---|---|---|
| 3147224 | 6/1983 | Fed. Rep. of Germany . | |
| 3241268 | 1/1984 | Fed. Rep. of Germany . | |
| 1076671 | 7/1967 | United Kingdom | 137/512.1 |

*Primary Examiner*—Harold Joyce

*Attorney, Agent, or Firm*—Lee, Smith & Zickert

[57] ABSTRACT

An induction type air outlet device comprises a ring of air outlet nozzles and a central passage in a partition of a housing. The air outlet nozzles are directed to the peripheral portions of an air guide blade assembly and entrains room air which enters through the central portion of this assembly. A pair of spring loaded flaps close the central passage. When the supply of fresh air to the device is increased beyond a certain level, the flaps are deflected and form a roof-shaped structure. Thus fresh air flowing through the passage blows against an increased area of the air guide blade assembly, whereby the ratio of fresh air and entrained room air is increased. The flaps are coupled through elongated toothed bodies.

3 Claims, 4 Drawing Figures

AIR OUTLET FOR AIR CONDITIONING SYSTEMS

BACKGROUND OF THE INVENTION

The invention relates to an air outlet device for air conditioning systems comprising:

(a) a housing, (b) air guide blade means closing the housing on one side thereof and having air guide blades extending obliquely outwards, said air guide blade means including peripheral portions and central portions, (c) a partition in said housing, said partition subdividing said housing into an inlet chamber and a second chamber which is limited by said air guide blade means, (d) an air inlet port in said housing, said air inlet port communicating with said inlet chamber, (e) a ring of air outlet nozzles provided in said partition and directed towards said peripheral portions of said air guide blade means, (f) a central passage in said partition opposite said central portions of said air guide blade means, and (g) spring-loaded flap means for controlling the air flow through said central passage.

PRIOR ART STATEMENT

Intermediate ceilings are inserted in large air conditioned rooms such as department stores. Ceiling air outlet devices are mounted in these intermediate ceilings and are connected through air supply conduits, which are installed above the intermediate ceiling with the aggregates of the air conditioning plant. Such ceiling air outlet devices should be so designed that air emerges at a convenient temperature, thus that there is no cold draught. Furthermore it is desirable to keep the energy consumtion for heating or driving power of a cooling aggregate and the required blower output small. These requirements are particularly advantageously met by what can be called induction type ceiling air outlet devices. With these induction type ceiling air outlet devices room air is aspirated due to injector effect by the air flow supplied through an air supply conduit and is mixed with this supplied air. Prior art ceiling air outlet devices of this type comprise a housing which has an air inlet port or socket connected to an air supply conduit. On its bottom side, which is flush with the intermediate ceiling of the room, the housing is closed by an air guide blade assembly. The air guide blade assembly comprises air guiding surfaces or blades which extend downwards and laterally outwards. The housing is subdivided by a partition into an upper inlet chamber, which communicats with the air inlet socket, and a second, lower chamber, which is limited by the air guide blade assembly. A ring of air outlet nozzles is provided in the partition. The air outlet nozzles are directed towards the peripheral portions of the air guide blade assembly. A central passage is provided in the partition opposite the central portions of the air guide blade assembly. In the prior art ceiling air outlet device, this aperture is covered by controlled flaps, which thus represent a means for controlling the air flow through the central passage. Flaps in the air supply conduit are controlled by a thermostat through a servomotor, and thereby the volume flow rate of the supplied air is controlled as a function of temperature. With a relatively low volume flow rate the central passage is closed by the flaps. The supplied air emerges through the air outlet nozzles and through the peripheral portions of the air guide blade assembly. Due to injector effect, room air is aspired through the central portions of the air guide blade assembly and is mixed with the emerging fresh air. The flaps are controlled by a pressure sensor in the upper inlet chamber of the housing. With increased volume flow rates, the flaps are opened progressively. Thereby the number of gaps of the air guide blade assembly through which air emerges is increased, and the number of gaps through which room air is aspired is reduced correspondingly. In this way the total emerging air flow rate is substantially constant, whereby good whirling and intermingling of room air and fresh air is ensured (German patent document No. 31 47 224).

With this prior art ceiling air outlet device two flaps are provided which are pivotably mounted about parallel pivot axes near a center line of the passage and are coupled with each other by means of a laterally arranged gear assembly such that the flaps are always rotated in opposite directions by the servomotor.

The prior art ceiling air outlet device wherein the central passage in the partition is closed by flaps which are movable by a pressure sensor through a servomotor, is rather complex and too expensive in practice.

German Pat. No. 32 41 268 shows a ceiling air outlet device of similar kind, which comprises a ring of air outlet nozzles and a central passage in a partition. The air outlet nozzles are directed towards peripheral portions of an air guide blade assembly. Air emerges from the peripheral portions and entrains room air which enters through the central portions of the air guide blade assembly. The fresh air flow supplied is divided in an air inlet socket. Part of the fresh air flows through an unrestricted passage of the air inlet socket into an annular chamber defined in the partition around the central passage. Another part of the fresh air flows through a passage, which is governed by a valve flap, into an inlet chamber defined on the inlet side of the partition and from there through the central passage of the partition. The valve flap is biased by a weight. The larger the supplied air flow is the more is the valve flap lifted so as to permit flow of air therethrough to the central passage.

Thereby an induction type ceiling air outlet device without auxiliary energy is obtained, which provides a substantially constant air flow, the proportion of the aspired and admixed room air being reduced with increasing volume flow rate of the air supplied through the air supply conduit.

The prior art device requires a partition which defines an annular chamber, and furthermore requires dividing of the air flow in the air inlet socket. In addition a biased flap has to be arranged in this air inlet socket. In practice this has resulted in certain design and assembly problems.

OBJECTS OF THE INVENTION

It is an object of the invention to provide a simplified air outlet device of the type in question.

In particular it is an object of the invention to provide an air outlet device of the type in question which is compact and thereby adapted to be combined, without problems, with other standardized parts of an air conditioning system.

STATEMENT OF THE INVENTION

According to the invention this object is achieved in that (h) said spring-loaded flap means comprise a flap assembly of pivotably mounted flaps which governs said central passage, (i) said flaps are pivotable from a closed position into said second chamber to open said passage, and (j) springs are provided acting on said flaps to urge them towards said closed position.

The flap assembly comprises a pair of flaps with adjacent edges. These flaps are pivotably mounted about parallel pivot axes close to a center line of the passage. Coupling means are provided for coupling the flaps for opposite pivotal movement. In a preferred embodiment the coupling means comprise elongated toothed bodies. Each flap has one of these toothed bodies attached thereto. The toothed bodies extend along the above mentioned adjacent edges of the flaps. The toothed bodies have toothings with longitudinal teeth and with reference circles curved about the pivot axis of the associated flap. The toothed bodies mesh with each other. Advantageously an intermediate housing is provided in the inlet chamber. This intermediate housing is open towards the partition and thereby forms an edge. This edge is attached to the partition around the central passage thereof. The intermediate housing has apertures therethrough, through which the inlet chamber communicates with the passage, and has an end face opposite the passage. The springs mentioned above are tension springs. Each spring has one end attached to one of the flaps and has its other end attached to the end face of the intermediate housing.

An embodiment of the invention is described in greater detail hereinbelow with reference to the accompanying drawings:

Figure 1:
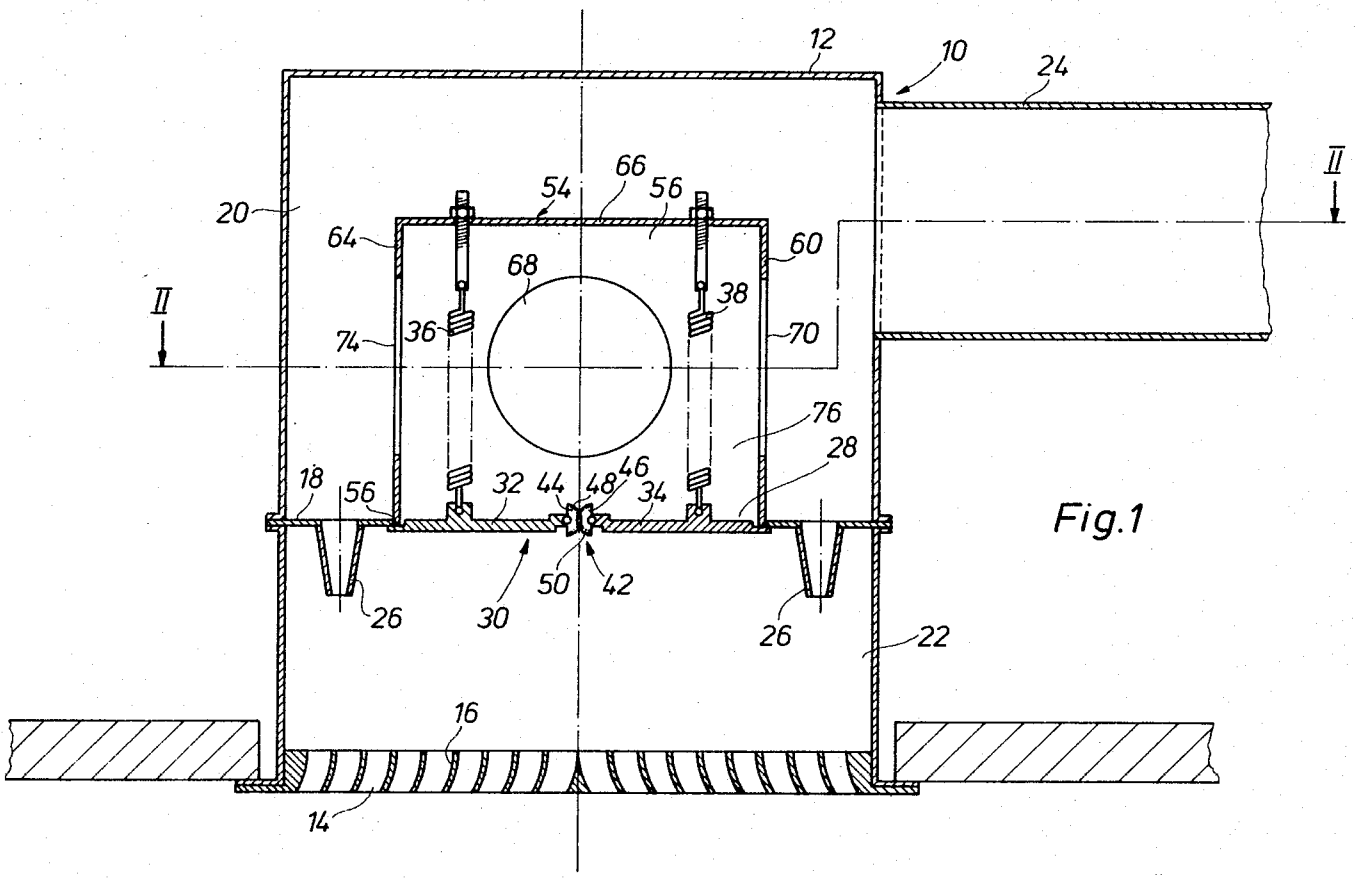
FIG. 1 is an elevational sectional view of a ceiling air outlet device, taken along line I—I of FIG. 2.
Figure 2:
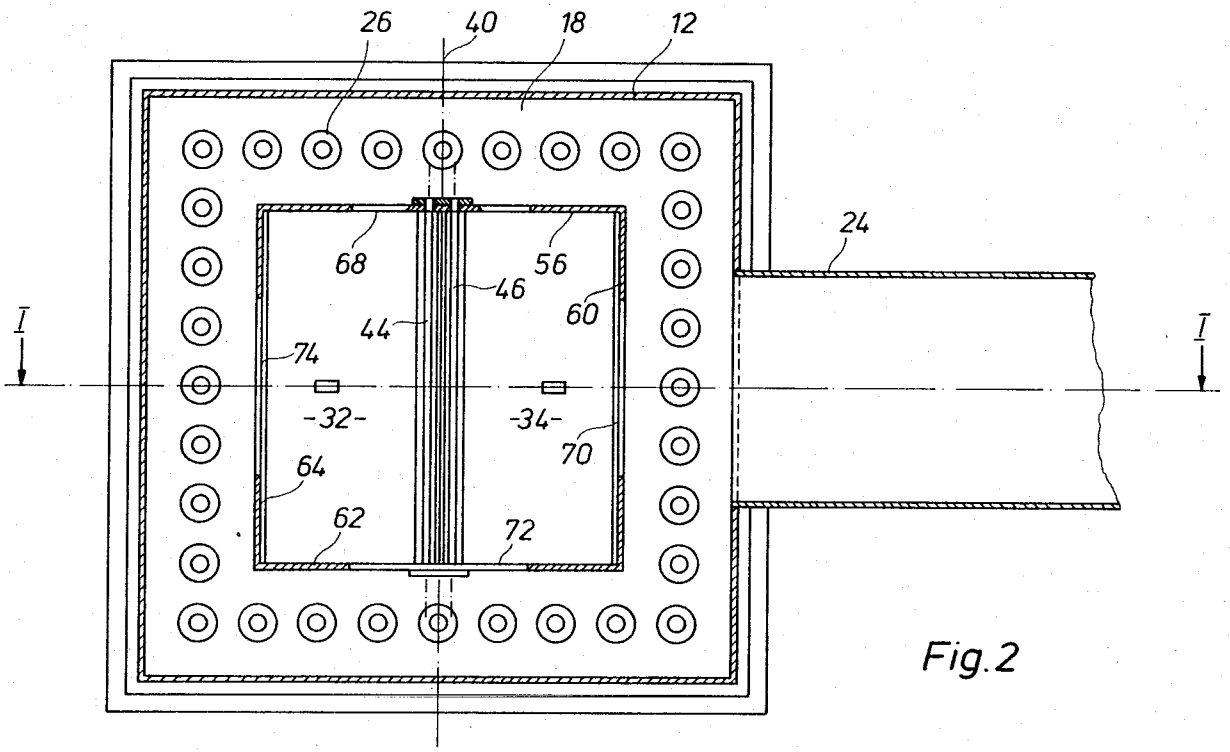
FIG. 2 is a cross sectional view of the ceiling air outlet device, taken along line II—II of FIG. 1.

A ceiling air outlet device for air conditioning systems is generally designated by 10. The ceiling air outlet device 10 comprises a rectangular housing 12. At its bottom face the housing 12 is closed by an air guide blade assembly 14. The air guide blade assembly 14 has air guiding surfaces or blades 16, which extend downwardly and laterally outwards. One group of air guiding surfaces 16 on the left in FIG. 1 extends towards the bottom to the left in the figure, and another group of air guiding surfaces 16 on the right in FIG. 1 extends towards the bottom to the right. The air guiding surfaces 16 are slightly curved to deflect an air flow incident from the top into the desired direction. A partition 18 is provided in the housing 12. The partition 18 subdivides the housing 12 into a first chamber or inlet chamber 20 and a second chamber 22. The second chamber 22 is limited at the bottom by the air guide blade assembly 14. An air inlet socket 24 is attached to the housing 12. The air inlet socket 24 communicates with the inlet chamber 20.

A ring of air outlet nozzles 26 is provided in the partition 18. The air outlet nozzles 26 are directed towards peripheral portions of the air guide blade assembly 14. Furthermore a central passage 28 is formed in the partition 18 opposite the central portions of the air guide blade assembly. Spring-loaded flap means 30 are provided for controlling the air flow through the central passage 28.

Figure 4:
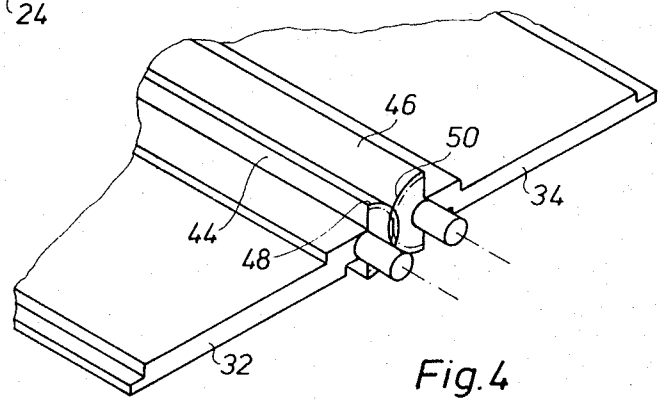
FIG. 4 is a fractional perspective illustration, at an enlarged scale, of the flaps and of the coupling means in the ceiling air outlet device.
Figure 3:
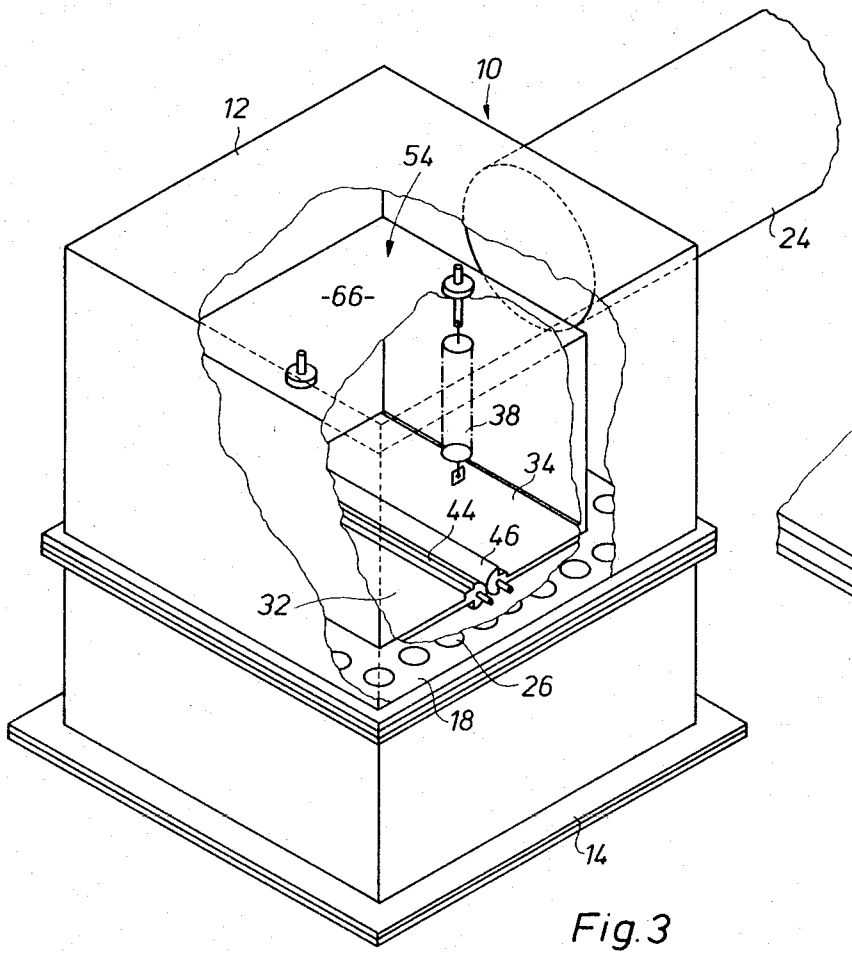
FIG. 3 is a perspective illustration of the ceiling air outlet device, certain parts being broken away to show details.

The spring-loaded flap means 30 for controlling the air flow comprise a flap assembly with a pair of pivotably mounted flaps 32 and 34, which govern the central passage 28. The flaps 32 and 34 are pivotable from closed positions (illustrated in FIG. 1) into said second chamber 22 to open the passage 28. Springs 36 and 38 are provided to urge the flaps 32 and 34, respectively, towards their closed positions. The flaps 32 and 34 are pivotably mounted about parallel pivot axes close to a center line 40 of the passage 28. Coupling means 42 are provided for coupling the flaps 32 and 34 and 34 for always opposite directions of rotation. These coupling means 42 comprise two elongated toothed bodies 44 and 46. The toothed bodies 44 and 46 extend along adjacent edges of the flaps 32 and 34, respectively. Toothed body 44 is attached to flap 32. Toothed body 46 is attached to flap 34. As can best be seen from FIG. 4, the toothed bodies 44 and 46 have tooothings 48 and 50 with longitudinally extending teeth. The reference circle of each of these toothings 48 and 50 is curved about the pivot axis of the associated flap 32 or 34, respectively. The toothings mesh with each other.

In this way not only rotary movement of the two flaps 32 and 34 in always opposite direction is ensured, which causes symmetry of the flap assembly and correspondingly symmetric distribution of the air flow, but the toothings, in each position of the flaps 32 and 34, provide a seal between the adjacent edges of the flaps 32 and 34. Thus no central air flow thorugh a gap between the flaps occurs, which would disturb the aspiration of room air from below in the center.

An intermediate housing 54 is arranged in the inlet chamber 20. The intermediate housing 54 is open towards the partition 18 and is attached to the partition along its edge 56 around the passage 28. The intermediate housing 54 is also rectangular with four side walls 58,60,62,64, and an end face 66 opposite the passage 28. The intermediate housing 58 has apertures 68,70,72 and 74 in the side walls 58,60,62 and 64, respectively. The inlet chamber 20 communicates with the interior of the intermediate housing 54 and the passage 28 through these apertures 68,70,72 and 74.

The springs 36 and 38 are tension springs, which are attached to the end face 66 with their ends remote from the flaps 32 and 34.

The device described operates as follows:

A fresh air flow, for example, is supplied the flow rate of which depends on the demand for fresh air detected by a sensor. If it is very warm in the building, a large fresh air flow is supplied. If the temperature is lower, the fresh air flow will be restricted. This is known conventional technology and therefore is not described here in detail. With an induction type ceiling air outlet device, these variable fresh air flows, which are supplied through the air inlet socket 24, are mixed with more or less room air so that a substantially constant air flow of agreeable temperature energes from the ceiling air outlet, and no cold draught occurs.

With small fresh air flow rate, the fresh air will emerge substantially from the air outlet nozzles 26. The air is then blown against the peripheral zones of the air guide blade assembly 14. Due to injector effect room air is aspired through the central portions of the air guide blade assembly and are admixed to the fesh air blown out. Then the emerging air contains a relatively low proportion of fresh air and a relatively high proportion of admixed room air.

When the quantity of fresh air is increased, dynamic pressure builds up upstream of the air outlet nozzles 26. The dynamic pressure acts on the flaps 32 and 34 and overcomes the springs 36 and 38, respectively. Thereby the flaps 32 and 34 are rotated in opposite directions exactly symmetrically to the center plane and form a roof-shaped structure. With increasing fresh air flow rate and thus increasing dynamic pressure, an increasing flow of fresh air flows through the central passage 28. The flaps 32 and 34 forming a roof-shaped structure direct the fresh air, at first to the peripheral portions of the air guide blade assembly 14 to permit room air to be aspired in the central portion of the air guide blade assembly 14. The stronger the fresh air flow becomes, the more are the flaps 32 and 34 deflected and the larger are the areas of the air guide blade assembly 14, against which the fresh air flows.

The toothing provides, as explained, at the same time a seal between the flaps 32 and 34. Thus the upward current of room air is not disturbed.

The invention has been described with reference to a ceiling air outlet device to be installed in and above an intermediate ceiling. The invention is, however, equally well applicable to air outlet devices which are to be installed in vertical walls or in a casing surrounding air supply conduits.

We claim:

1. An air outlet device for air conditioning systems comprising:

(a) a housing, (b) air guide blade means closing the housing on one side thereof and having air guide blades extending obliquely outwards, said air guide blade means including peripheral portions and central portions, (c) a partition in said housing, said partion subdividing said housing into an inlet chamber and a second chamber which is limited by said air guide blade means, (d) an air inlet port in said housing, said air inlet port communicating with said inlet chamber, (e) a ring of air outlet nozzles provided in said partition and directed towards said peripheral portions of said air guide blade means, (f) a central passage in said partition opposite said central portions of said air guide blade means, and (g) spring-loaded flap means for controlling the air flow through said central passage, characterized in that (h) said spring-loaded flap means comprise a flap assembly of pivotably mounted flaps which governs said central passage, (i) said flaps are pivotable from a closed position into said second chamber to open said passage, (j) springs are provided acting on said flaps to urge them towards said closed position, (k) an intermediate housing is provided in said inlet chamber, said intermediate housing being open towards said partition and thereby forming an edge, said edge being attached to said partition around said passage, (l) said intermediate housing has apertures therethrough, through which said inlet chamber communicates with said passage, and has an end face opposite said passage, and (m) said springs are tension springs, each having one end attached to one of said flaps and having its other end attached to said end face.

2. An air outlet device as claimed in claim 1, characterized in that said flap assembly comprises (a) a pair of flaps with adjacent edges, said flaps being pivotably mounted about parallel pivot axes close to a center line of said passage, and (b) coupling means for coupling said flaps for opposite pivotal movement.

3. An air outlet device as claimed in claim 2, characterized in that said coupling means comprise elongated toothed bodies, (a) each said flap having one of said toothed bodies attached thereto, (b) said toothed bodies extending along said adjacent edges of said flaps, and (c) said toothed bodies having toothings with longitudinal teeth and with reference circles curved about the pivot axis of the associated flap, and meshing with each other.

* * * * *